US005090230A

United States Patent [19]

Koskinen

[11] Patent Number: 5,090,230

[45] Date of Patent: Feb. 25, 1992

[54] PIPE EXPANDING PLIERS

[75] Inventor: Kauno L. J. Koskinen, Hartola, Finland

[73] Assignee: Kauno Koskinen Ky, Hartola, Finland

[21] Appl. No.: 679,640

[22] Filed: Apr. 2, 1991

[51] Int. Cl.[5] ..... B21D 41/02

[52] U.S. Cl. ..... 72/393

[58] Field of Search ..... 72/393

[56] References Cited

U.S. PATENT DOCUMENTS 4,735,078 4/1988 Wesebaum ..... 72/393

4,890,472 1/1990 Rothenberger ..... 72/393

FOREIGN PATENT DOCUMENTS 0852770 7/1985 Finland .

*Primary Examiner*—Lowell A. Larson

*Attorney, Agent, or Firm*—McAulay Fisher Nissen Goldberg & Kiel

[57] ABSTRACT

A pipe expanding tool comprising a cylindraceous member having a pipe of oppositely disposed openings and an outer collar; a conical-shaped stepped expander having segmental members including a top stepped portion receivable with the collar, an elastic member receivable in the top stepped portion for urging the segmental members together to close longitudinal slits therebetween; an axially movable spreader receivable within the expander for overcoming compression on the top stepped portion exerted by the elastic member to spread the segmental members away from each other; a plunger for movement of the segmental members transversely of a longitudinal axis of the plunger and spreader; and an arm bearing against the plunger to move the spreader into the expander for increasing the outer diameter thereof and for movement in an opposite direction out of the expander so that the elastic material urges the segmental members together to close longitudinal slits for decreasing the outer diameter of the expander.

20 Claims, 7 Drawing Sheets

PIPE EXPANDING PLIERS

BACKGROUND OF THE INVENTION

1. Field of the Invention

This invention relates to pipe expanding pliers, especially useful for use in connection with copper pipes which have to be soldered together.

2. Description of Prior Art

Copper pipes which are generally easily handable are useful for plumbing installations, as well as other installations, because of their ease of cutting and bending. The pipes are generally made of finite length and generally have to be connected together by soldering, clamping or otherwise. Generally, a pipe run is formed from the same internal diameter pipe and couplings by soldering, or clamps are used to connect them together by clamping.

To avoid the use of clamps or couplings, one end of one pipe which forms a female end is flared in order to receive the end of another pipe which forms the male end for soldering together.

Flaring of the one end of a pipe has been conventionally accomplished with different types of tools for this purpose.

Reference is made to U.S. Design Pat. No. D 265,377 which shows a prior art tube expander tool.

SUMMARY OF THE INVENTION

It is an object of the invention to provide a hand-held tool to be used as pipe expanding pliers. It is a further object of the invention to provide pipe expanding pliers which can be used by an individual so that the pipe having the end to be expanded and the pliers can be operated by a single individual.

To these ends, the pipe expanding tool according to the invention comprises a cylindraceous member having a hollow interior and a longitudinal axis, a pair of oppositely disposed openings axially aligned with the longitudinal axis, and an outer collar at one end of the cylindraceous member, a conical-shaped segmented stepped expander including at least two segmental members together forming a completed outer surface and defining a longitudinal slit between adjacent faces of the segmental members and having an increasing outer diameter increasing in a stepped direction and a conical-shaped interior surface portion and including a top stepped portion receivable with the outer collar, the segmental members together forming a segmented member having a conical interior, an elastic receivable within a U-shaped portion provided in the top stepped portion which is receivable in the outer collar for urging the segmental members together to close the longitudinal slits, an axially movable spreader receivable within the conical-shaped interior of the segmented stepped expander and the hollow interior having an axis coaxial with the longitudinal axis for spreading the segmental members away from each other in a direction transverse to the longitudinal axis as the spreader is moved along the longitudinal axis towards the collar, a plunger receivable within the cylindraceous member movable in a direction axially along the longitudinal axis and towards the collar for movement of the spreader axially longitudinally and the stepped expander transversely of the longitudinal axis, and a hand-held portion including a first handle fixedly connected with the cylindraceous member and a second handle including a movable arm movable relative to the first handle and movably associated with the plunger for movement of the spreader, the movable arm passing through the oppositely disposed openings and bearing against the plunger for movement thereof along the longitudinal axis to cause the spreader to move into the stepped segmental members for increasing the outer diameter thereof and for movement out of the stepped segmental members and the elastic urging the segmental members together for decreasing the outer diameter thereof.

The movable arm includes stepped portions to cooperate with the cylindraceous member to move the spreader in the direction of the collar and out of the stepped segmented expander and a pivoted member pivotally connected with an end of the arm and cooperating with the cylindraceous member to cause the spreader to be withdrawn inwardly into the expander.

The present invention is an improvement over my earlier design in that only a single hand is necessary to operate the tool so that a holding device for the pipe is unnecessary. Also, with the collar and stepped portion held therein, there is less chance for the segmental elements to become disengaged so that the tool does not have to be reassembled in the field. There is also less chance that the elastic members holding the segmental members will become dislodged or tear.

DESCRIPTION OF THE PREFERRED EMBODIMENT

Figure 1:
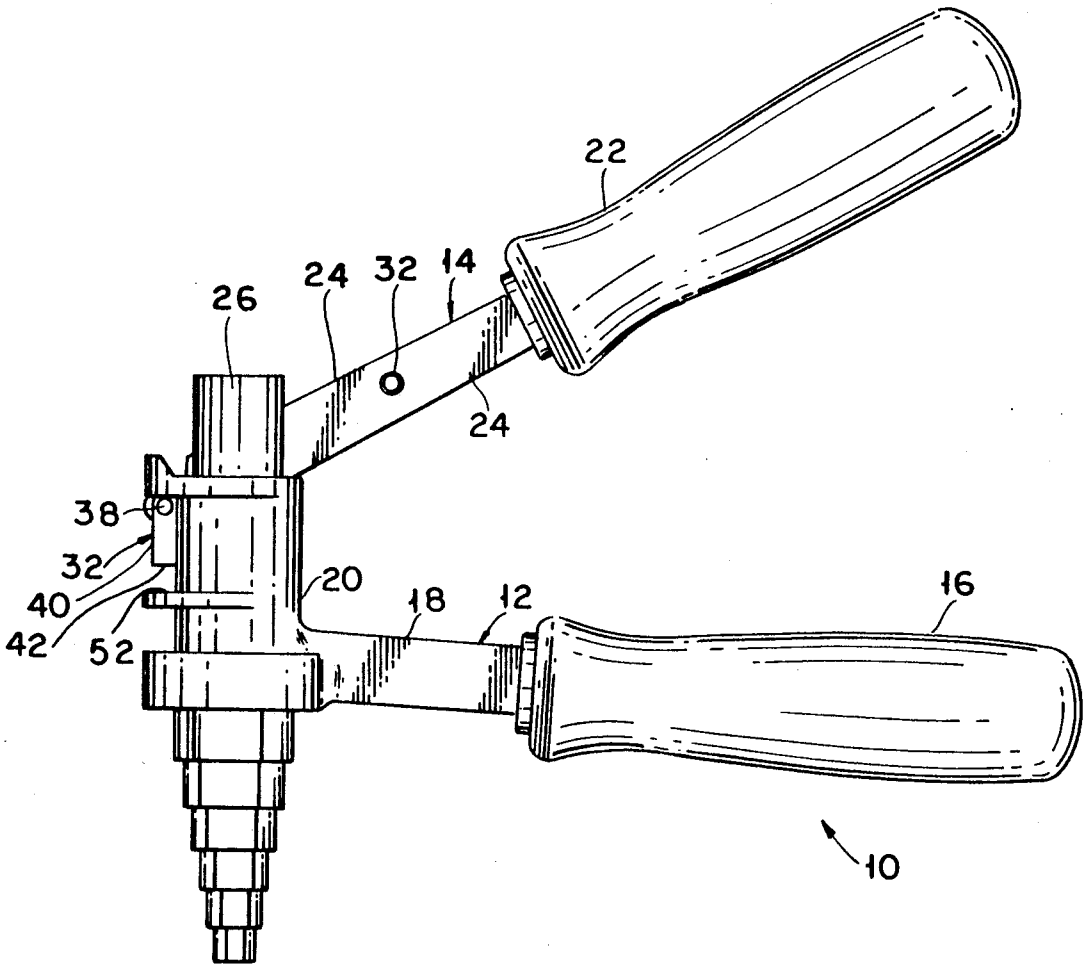
FIG. 1 is a side view of a pipe expanding tool in its retracted condition.
Figure 2:
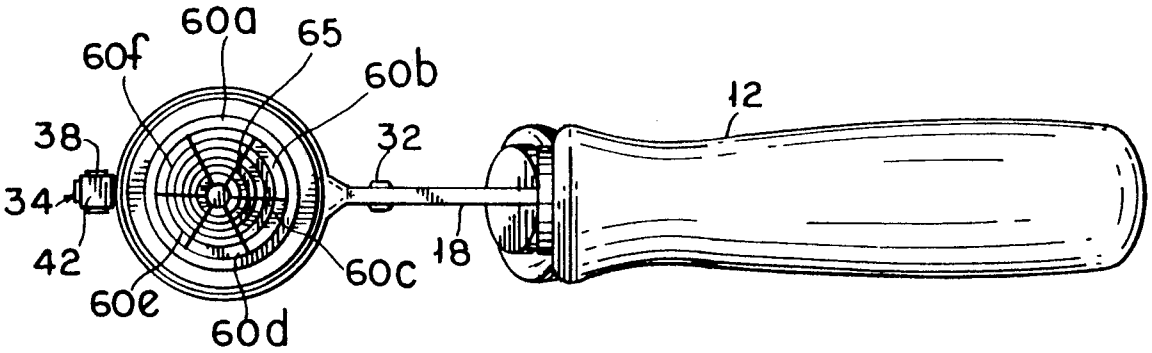
FIG. 2 is a bottom view of the tool as shown in FIG. 1 in its retracted condition.
Figure 3:
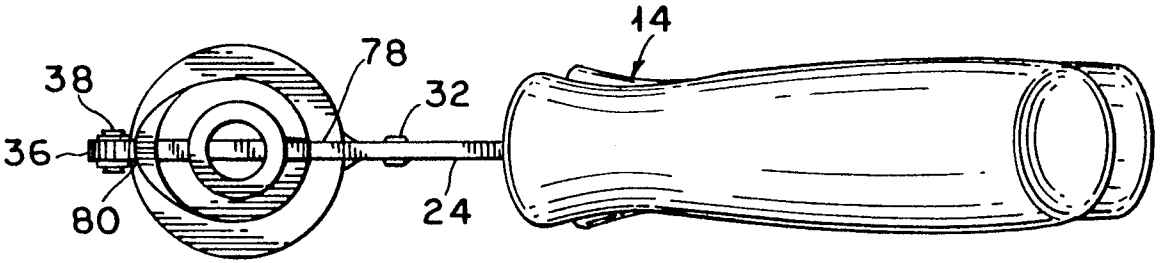
FIG. 3 is a top view of the tool in its retracted condition as shown in FIG. 1.
Figure 4:
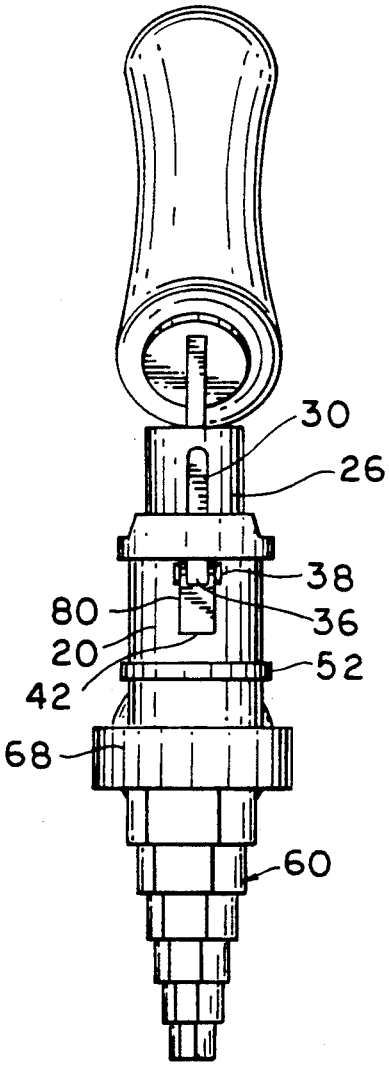
FIG. 4 is a front view of the tool in its retracted condition as shown in FIG. 1.
Figure 9:
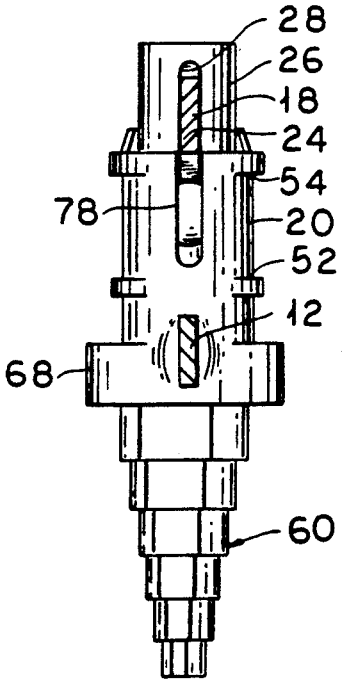
FIG. 9 is a rear view of the tool as shown in FIG. 2 in its retracted condition, partially in section with a portion of the handles omitted.

Referring now more particularly to the drawings and, in particular, to FIGS. 1 to 9 which show the best mode presently contemplated for carrying out the invention, the pipe expanding pliers 10 includes first and second handle members 12, 14. First handle member 12 includes handle portion 16 and fixed arm 18 fixedly coupled with a hollow cylindrical member 20. Second handle member 14 includes a handle portion 22 coupled with a movable arm 24.

Received within cylindrical member 20 is a movable plunger 26 having a central axis coaxial with the axis of cylindrical member 20. Plunger 26 includes a pair of spaced longitudinal oval openings 28, 30 (see FIGS. 4, 5 and 9) aligned with each other through which movable arm 24 passes in a direction transverse to the central axis of the cylindrical member 20 and plunger 26. Movement of movable arm 24 in the transverse direction is limited by a stop member 32 on movable arm 24 and another stop 34 at the outer end 36 of arm 24. Stop 34 includes at outer end 36, a pivot pin 38 and pivotal member 40 which pivots on pin 38 relative to end 36. Pivotal member 40 also includes a bearing base 42 which is adapted to bear against bearing surface 52.

As best seen in FIGS. 5 to 8, arm 24 includes a three step stepped portion 44 having steps 44*a*, 44*b*, 44*c* to provide three degrees of extension for cone-shaped spreader 46.

Spreader 46 is cone-shaped to conform to the interior of metal expander 60 and includes a base portion 48 which forms a bearing surface in contact with another bearing surface formed by a base 50 of plunger 26.

Cylindrical member 20 is generally cylindraceous in shape and includes, on an outer periphery thereof, a pair of spaced bearing surfaces 52, 54 to control the angular movement of movable arm 24 in a plane containing the longitudinal axis of plunger 26 and perpendicular to the plane defined by base portion 48 and base 50 of the plunger when in contact with each other. Bearing surface 42 cooperates with bearing surface 52 to cause spreader 46 to move inwardly of cylindrical member 20, and bearing surface 54 cooperates with the different steps of stepped portion 44 to cause spreader 46 to move in a downward direction out of cylindrical or cylindraceous member 20.

Positioned within plunger 20 is a ball member 56 which bears against a bearing surface 58 formed by the lower edge of movable arm 24. Bearing surface 58 pivots on ball bearing member 56 to cause spreader 46 to move out of cylindrical member 20 to the positions shown in FIGS. 6 to 8.

Spreader 46 cooperates with metal expander 60 which has a stepped surface 62 comprising six similar elements 60*a*, 60*b*, 60*c*, 60*d*, 60*e* and 60*f*, but of different and increasing diametrical extent in a direction of the longitudinal axis, each of which forms a sector of a conical-shaped member and together forms a stepped-cylindraceous surface or stepped surface 62. Top stepped portion 64 includes a circumferential U-shaped portion 66 which receives an elastic member or ring of elastic material 67 to hold expander elements 60*a*, 60*b* . . . 60*f* together while permitting a limited amount of expansion and provide a longitudinal space 65 between adjacent elements 60*a*, 60*b*, etc. The reference numeral 65 indicates a separation between the adjacent elements 60*a*, 60*b*, 60*c*, 60*d*, 60*e* and 60*f* to form the longitudinal space.

Cylindrical member 20 includes an outer collar 68 having an inner peripheral member or locator guide 70 receivable within U-shaped portion 66 for centering and locating expander 60 within cylindrical member 20. Expander 60 is provided with a hollow inner conical surface portion 72 to receive spreader 46 and allow it to move axially in response to different positions of movable arm 24 depending on the position of stepped portion 44 in contact with stop 54.

DESCRIPTION OF OPERATION

Movable arm 24 and its end 36 is provided with the stepped portion 44. While three stepped portions 44*a*, 44*b* and 44*c* are shown, it is within the scope of the invention to provide more or less stepped portions, depending upon the type of use to which the tool is to be put.

The movable arm 24 presses the cone-shaped spindle which acts as a spreader 46 through the intermediation of the metal ball bearing 56. With the tool according to the present invention, the amount of power needed for pressing the spreader 46 reduces the amount of effort to about one third compared to present day known pliers. Also, there is no need to change any parts in the tool when the pipes of different sizes are to be used.

The ring of elastic material 67 in the U-shaped portion 66 binds the expander elements together. The outer ring-shaped member or outer collar 68 together with the inner peripheral member 70 permits the parts to draw away from each other when expanded and because of the cooperation between the spreader and the ring of elastic material 67 draws the expander elements 60*a* . . . 60*f* together to close when the movable arm is lifted up and the tool goes into the pipe for expanding and, as the spreader moves in the opposite direction, it overcomes the action of the elastic material and the expander elements have their outer diameter increased.

Figure 5:
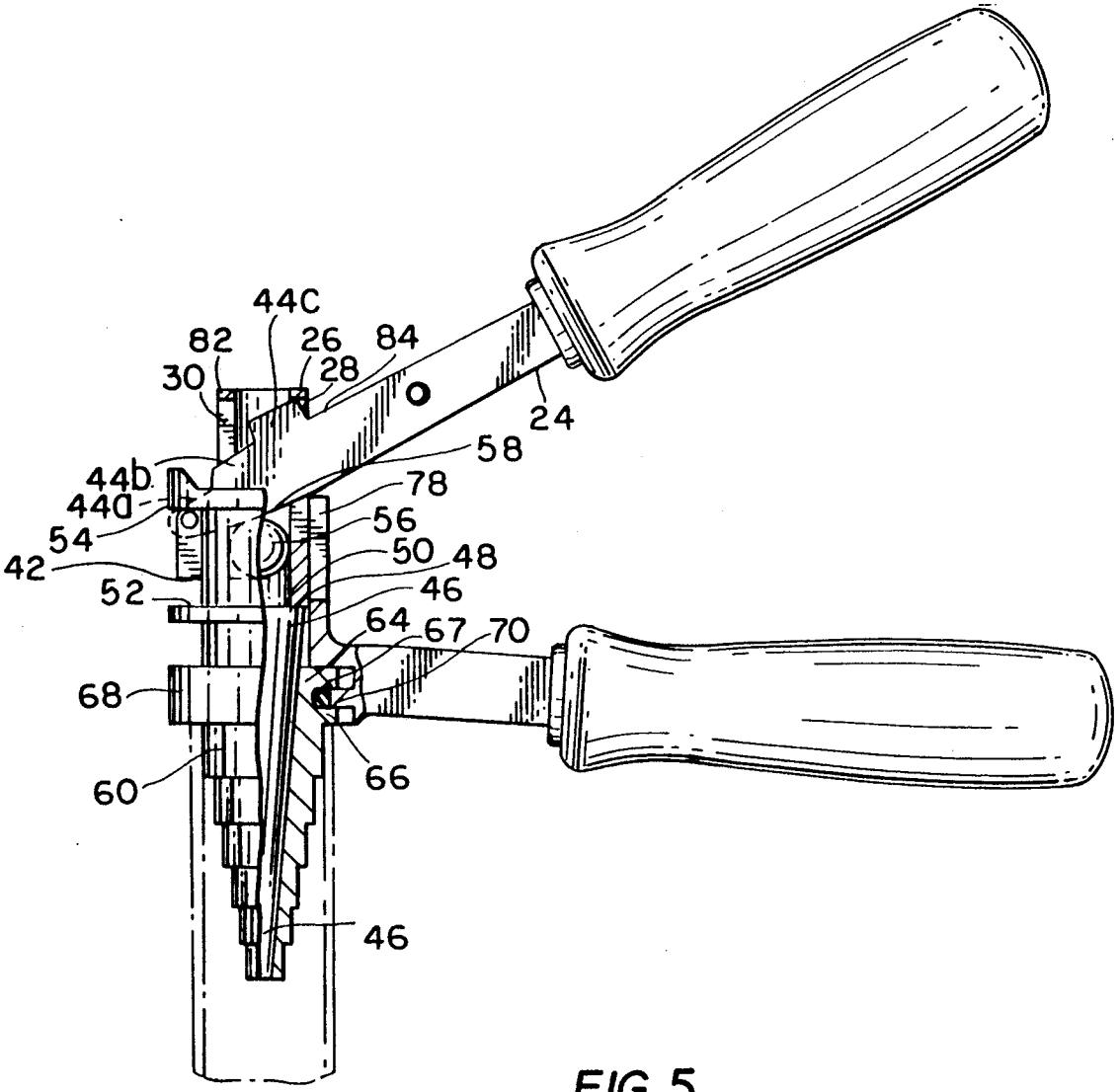
FIG. 5 is a partial cross-sectional view of the tool shown in its retracted position inserted into a pipe and just prior to expansion or flaring of the end of a pipe shown in phantom.
Figure 6:
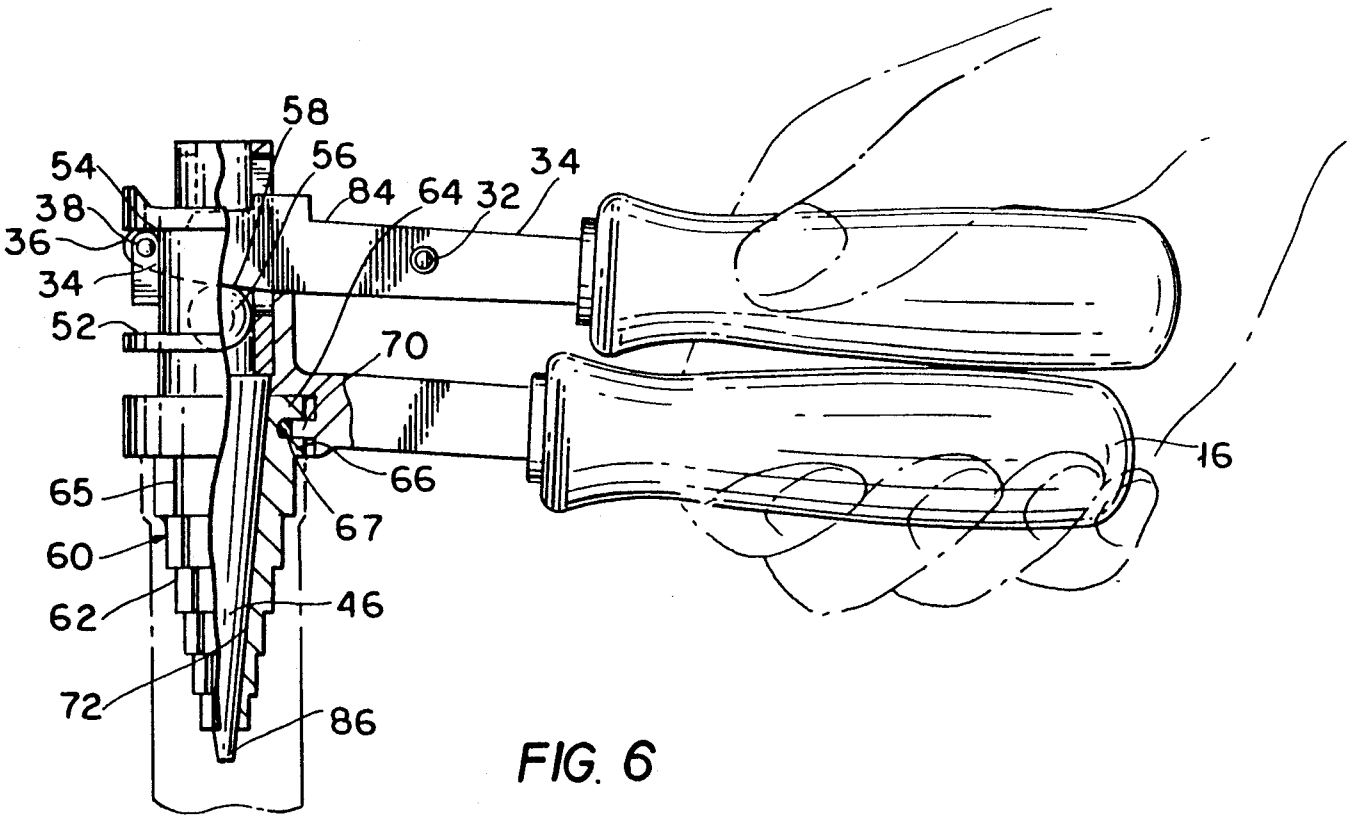
FIG. 6 is a partial cross-sectional view of the tool shown in a non-retracted condition and in a step one extended expansion to provide for a first internal diameter pipe expansion.
Figure 7:
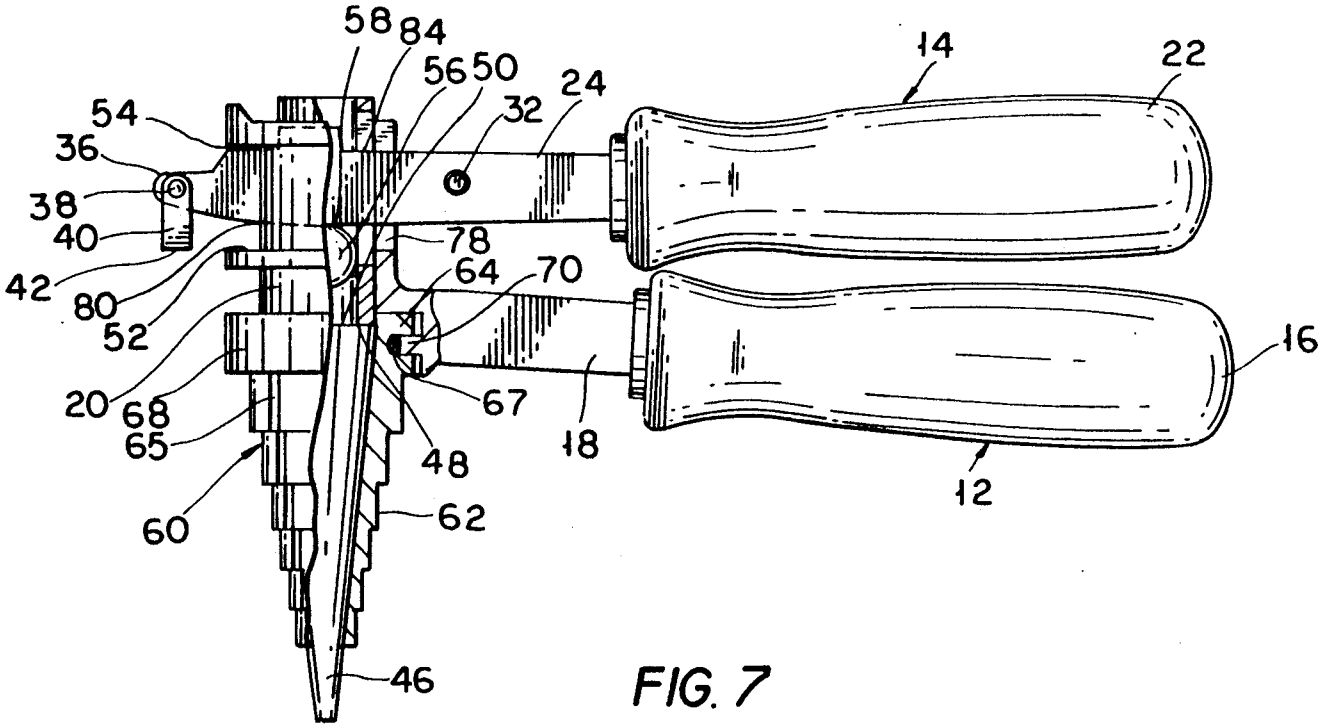
FIG. 7 is a view similar to that shown in FIG. 6 in a step two extended expansion.
Figure 8:
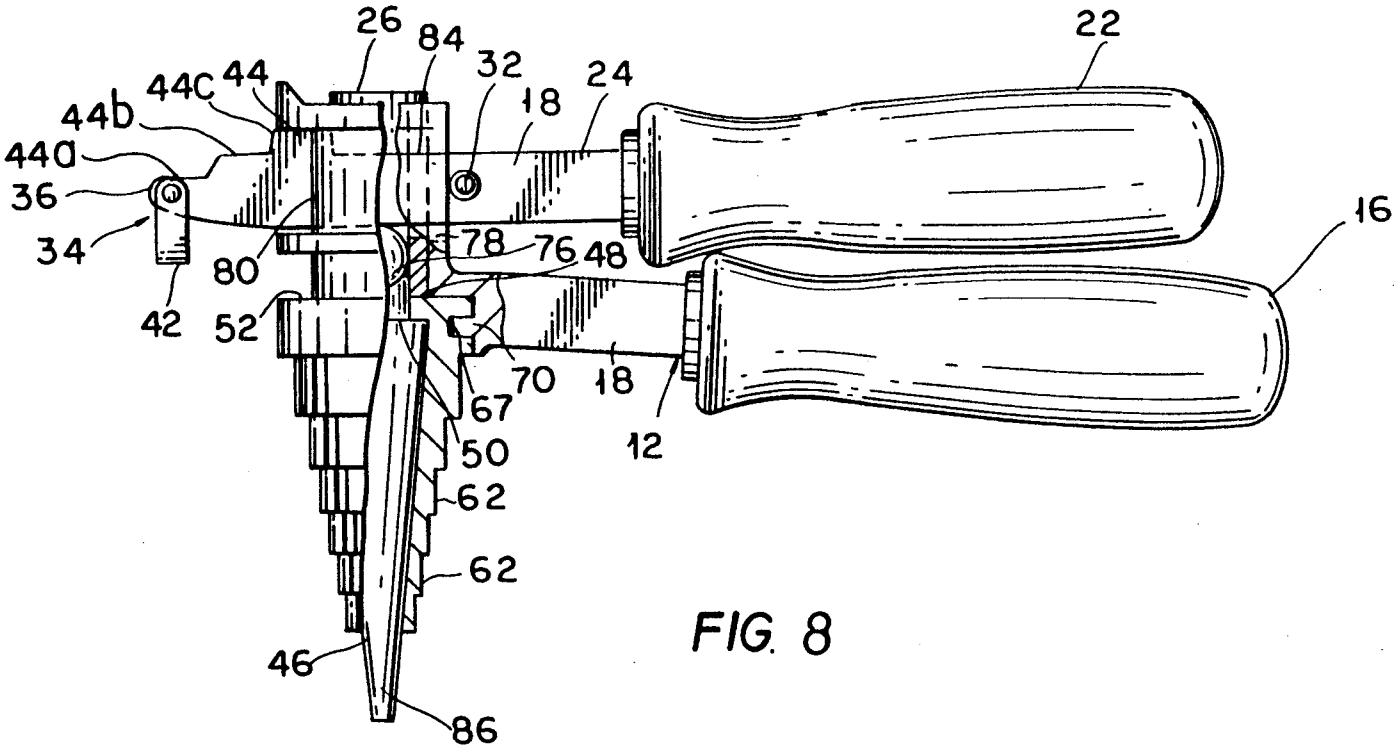
FIG. 8 is view similar to that shown in FIG. 6 in a step three extended expansion.

Each of the individual steps 44*a*, 44*b*, 44*c* engages with upper bearing surface 54 to cause spreader 46 to move in a vertical direction downwardly. FIG. 1 shows the outer end 36 engaged with surface 54 which is the most inwardly drawn position of spreader 46. FIG. 5 shows spreader 46 inside expander 60 for a first position. FIG. 6 shows step 44*a* engaged with bearing surface 54 and spreader 46 moved out for a second position or its first outside position, and FIG. 8 shows bearing surface 54 in contact with step 46*c* and the spreader 46 moved out for its third outside position or fourth position. FIG. 7 shows a position intermediate the FIGS. 6 and 8 positions. The plunger member 26 has a hollow interior and its pair of spaced oval openings 28, 30 axially aligned with the longitudinal axis of spreader 46 and diametrically opposed to each other for receiving the movable arm, and ball bearing retainer 76 is provided within the plunger member and ball bearing 56 is received within the ball bearing retainer 76. The movable arm includes a bearing portion or surface 58 for engagement with the ball bearing 56 and is pivotally movable on the ball bearing, and the plunger member includes a bearing surface 48 for engagement with bearing surface 50 on the spreader for movement thereof along the longitudinal axis. The first and second bearing shoulders 52, 54 are provided on the outer surface of the cylindraceous member and are spaced about a pair of oppositely disposed U-shaped openings 78, 80 in cylinder 20. The first or upper shoulder forming bearing surface 54 has a U-shaped opening transverse to the longitudinal axis and connecting with the U-shaped opening 80 and the outer shoulder 52 is below the U-shaped opening 80. The plunger also has the pair of diametrically spaced oval openings 28, 30 aligned with the U-shaped openings 78, 80, respectively, and the movable arm 24 extends through the U-shaped openings and the oval openings for movement of the plunger along the longitudinal axis.

While movable arm 24 can include more than three steps, it can also include at the one end thereof only two individual steps 44*a* and 44*b*, each of the steps being engageable with the upper shoulder portion 54 and one of the steps being engageable with an end 82 of one of the diametrically spaced oval openings 30 for moving the plunger in different directions along the longitudinal axis.

The bearing surface 42 on the pivotal member 40 is pivotally connected with arm 24 and is engageable with the lower bearing shoulder 52 to cause the plunger to control and to permit the spreader to move axially upwardly along the longitudinal axis and decrease the outer diameter of the expander, and a bearing surface 84 on top of movable arm 24 is engageable with the plunger while the bearing surface is urging the plunger upwardly and the spreader in a first longitudinal direction towards the collar to allow the expander to contract. Movement of the plunger in the opposite longitudinal direction causes the expander to spread.

The spreader 46 has a conical-shaped outer configuration of increasing diameter, from an apex 86 towards base 48 thereof, the base forming a first engaging bearing surface for contact with the base of the plunger to form a second engaging bearing surface with the engaging bearing surfaces bearing against each other to move the expander longitudinally. The stepped expander 60 which includes the plurality of equally shaped segmental portions each transversely spread together in a radial direction transversely to the longitudinal axis, the transverse spreading being controlled and guided by the ring of elastic material 67 and a guide in the form of the inner peripheral member 70 in the collar. The guide also includes the cooperation between the circumferential U-shaped portion 66 and the inner peripheral member 70 on the interior of the collar, the circumferential U-shaped portion receives the inner peripheral member for holding one end of the segmental expander elements within the collar. The U-shaped portion is on the largest segment of the segmental expander. The topmost stepped portion cooperates with the pivotal member 40 to move the plunger in an upward direction to retract the spreader 46 within the expander 60.

Each of the stepped portions is engageable with the upper shoulder 54 for movement of the spreader in a longitudinal direction away from the upper shoulder and in a direction away from the collar 68. The pivotal member 40 is pivotally connected with an end of the arm for engagement with the lower shoulder 52 to move the spreader in a longitudinal direction away from the lower shoulder. The last or third stepped portion 40*c* cooperates with the pivotal member 40 to move the plunger 265 in an upward direction away from the spreader 46. The pivotal member includes a bearing surface 42 for engagement with the shoulder 52 of cylinder 20 for movement of the spreader means longitudinally out of the segmented stepped expander to decrease the outer diameter thereof. The pivotal member 40 is pivotal out of engagement with the shoulder 52 of cylinder 20 for movement of the plunger in a vertical direction downwardly to cause the spreader to increase the outer diameter of the segmented expander.

The pivotal member 40 also acts as stop 34 at the outer end of movable arm 24 which together with stop 32 also on the movable arm limits the transverse movement of the arm and controls the placement of the steps 44*a*, 44*b* and 44*c* for ease of positioning. The opening means 78 and 80 in cylinder 20 are U-shaped openings and diametrically opposed and aligned with each other so that a track is formed for the longitudinal movement of the movable arm 24, and the outer collar extending below the openings for positioning the expander and spreader relative to the movable arm.

While there is shown what is considered to be the preferred embodiments of the invention, it will be obvious to those skilled in the art that various changes and modifications may be made therein without departing from the scope of the invention.

I claim:

1. A pipe expanding tool, comprising:

a cylindraceous member having a hollow interior and longitudinal axis, a pair of oppositely disposed opening means axially aligned with said longitudinal axis, and outer collar means at one end of said cylindraceous member;

a conical-shaped segmented stepped expander including at least two segmental members together forming a completed outer conical surface and defining a longitudinal slit between adjacent faces, said stepped expander including stepped portions having an increasing outer diameter increasing in a stepped direction with a diameter greater than the diameter of the other stepped portion, a top stepped portion receivable with said outer collar means, said segmental members together forming said segmented expander having a conical-shaped interior;

elastic means receivable in means provided in said top stepped portion, receivable in said outer collar means for urging said segmental members together to close said longitudinal slits therebetween;

axially movable spreader means receivable within said conical-shaped interior and said hollow interior having an axis coaxial with said longitudinal axis for overcoming compression on said top stepped portion by said elastic means holding said segmental members together for spreading said segmental members away from each other in a direction transverse to said longitudinal axis as said spreader means is moved orthogonally to said transverse direction along said longitudinal axis away from said collar means;

plunger means receivable within said hollow interior of said cylindraceous member movable in a direction axially along said longitudinal axis and towards said collar means for movement of said spreader means longitudinally and said segmental members of said stepped expander transversely of said longitudinal axis; and handle means including a first handle fixedly connected with said cylindraceous member and a second handle including a movable arm movable relative to said first handle and movably associated with said plunger means for movement of said spreader means, said movable arm passing through said oppositely disposed opening means and bearing against said plunger means for movement thereof in a first direction along said longitudinal axis to cause said spreader means to move into said stepped segmental members for increasing the outer diameter thereof and in a second direction along said longitudinal axis for movement out of said stepped segmental members and to enable said elastic means to urge said segmental members together to close said longitudinal slits for decreasing the outer diameter o said stepped expander.

2. The pipe expanding tool as claimed in claim I, wherein said plunger means includes:

a plunger member having a hollow interior and a pair of spaced oval openings axially aligned with said longitudinal axis and diametrically opposed to each other for receiving said movable arm; and ball bearing retainer means within said plunger member and ball bearing means received within said ball bearing retainer means;

said movable arm including a first bearing portion for engagement with said ball bearing means and pivotally movable on said ball bearing means;

said plunger member including a bearing surface for engagement with a bearing surface on said spreader means for movement thereof along said longitudinal axis.

3. The pipe expanding tool as claimed in claim 1, including:

first and second bearing shoulders on an outer surface of said cylindraceous member; and wherein:

said pair of oppositely disposed opening means includes U-shaped openings, said first shoulder having a U-shaped opening transverse to said longitudinal axis and connecting with one of said U-shaped opening means and said second shoulder being below said on U-shaped opening; and said plunger means includes a plunger having a pair of diametrically spaced oval openings aligned with said U-shaped openings, and said movable arm extending through said U-shaped openings and said oval openings for movement of said plunger along said longitudinal axis.

4. The pipe expanding tool as claimed in claim 3, wherein said movable arm includes:

on one end thereof, a first stepped portion including at least two individuals steps, each of said steps being engageable with said first bearing shoulder and one of said steps being engageable with an end of one of said diametrically spaced oval openings for moving said plunger in different directions along said longitudinal axis;

a first bearing surface pivotally connected therewith engageable with said second bearing shoulder and said plunge for raising thereof and permitting said spreader means to move axially along said longitudinal axis towards said collar means and decrease the outer diameter of said stepped expander; and a second bearing surface engageable interiorly of said plunger co-acting with said stepped portion urging said spreader and said plunger in a first longitudinal direction towards said collar means and a second bearing surface for urging the plunger in said second longitudinal direction away from said collar means.

5. The tool as claimed in claim 4, wherein said plunger includes interiorly thereof ball bearing retaining means and a ball bearing received within said ball bearing retaining means for bearing onto said second bearing surface and moving said spreader axially along said longitudinal axis in said first direction.

6. The tool as claimed in claim 5, wherein said expander has a conical-shaped outer configuration of increasing diameter, from an apex towards a base thereof to conform to said conical-shaped interior of said segmented expander, said base forming a first engaging bearing surface for contact with a base of said plunger to form a second engaging bearing surface with said engaging bearing surfaces bearing against each other to move said expander longitudinally in a direction way from said collar means.

7. The tool as claimed in claim 4, wherein said stepped portion on said movable arm includes three separate stepped portions for engagement with said cylindraceous member for moving said spreader means to three different extended positions longitudinally.

8. The tool as claimed in claim 7, including:

an upper shoulder and a lower shoulder on said cylindraceous member;

said opening means extending from said lower shoulder to a position above said upper shoulder;

each of said stepped portions being engageable with said upper shoulder for movement of said spreader means in said longitudinal direction away from said upper shoulder and said collar means; and a member pivotally connected with an end of said arm for engagement with said lower shoulder to move said spreader in said longitudinal direction away from said lower shoulder.

9. The tool as claimed in claim 8, wherein one of said stepped portions cooperates with said pivotal member to move said plunger in said second direction.

10. The tool as claimed in claim 1, including a pivotal member pivotally connected with an end of said movable arm, said pivotal member including a bearing surface for engagement with said cylindraceous member for movement of said spreader means longitudinally in a second direction out of said segmented stepped expander to decrease the outer diameter thereof.

11. The tool as claimed in claim 1, wherein said stepped expander includes a plurality of equally shaped segmental portions each transversely spreadable in a radial direction transversely to said longitudinal axis, said transverse spreading being controlled and guided by said elastic means and guide means in said collar means.

12. The tool as claimed in claim 11, wherein said guide means includes an inner peripheral member on the interior of said collar means, and said segmental expander includes on said top stepped portion a circumferential U-shaped portion for receiving said inner peripheral member for holding of said segmental expander within said collar means in a contracted condition thereof as urged by said elastic means.

13. The tool as claimed in claim 12, wherein said top stepped portion is the largest stepped portion.

14. The tool as claimed in claim 12, wherein said elastic means is received within said U-shaped portion.

15. The tool as claimed in claim 10, wherein said pivotal member is pivotal out of engagement with said cylindraceous member for movement of said plunger in said first direction to increase the outer diameter of said segmented expander.

16. The tool as claimed in claim 10, wherein said movable arm includes stepped portions and one of said stepped portions cooperates with said pivotal member to move said plunger in said second direction.

17. The tool as claimed in claim 16, including stop means on an outer end of said movable arm to limit the movement of said arm.

18. The tool as claimed in claim 16, including a stop on said arm to control the movement of said arm transversely to said longitudinal axis.

19. The pipe tool as claimed in claim 1, wherein said opening means are U-shaped openings and diametrically opposed and aligned with each other, said outer collar means extending below said opening means.

20. The tool as claimed in claim 1, including a stop on said arm to control the movement of said arm transversely to said longitudinal axis.

* * * * *